US008217846B1

(12) United States Patent
Buckley

(10) Patent No.: US 8,217,846 B1
(45) Date of Patent: Jul. 10, 2012

(54) LOW PROFILE DUAL-POLARIZED RADIATING ELEMENT WITH COINCIDENT PHASE CENTERS

(75) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 406 days.

(21) Appl. No.: 12/643,566

(22) Filed: Dec. 21, 2009

(51) Int. Cl.
*H01Q 1/00* (2006.01)

(52) U.S. Cl. ..... 343/730; 343/770; 343/795

(58) Field of Classification Search ..... 343/700 MS, 343/730, 770, 793, 794, 795
See application file for complete search history.

(56) References Cited

U.S. PATENT DOCUMENTS 6,864,840 B2 * 3/2005 Zhu et al. ..... 343/700 MS
7,262,740 B2 * 8/2007 Tikhov et al. ..... 343/770

* cited by examiner

*Primary Examiner* — Tan Ho
(74) *Attorney, Agent, or Firm* — Donna P. Suchy; Daniel N. Barbieri

(57) ABSTRACT

The present invention is directed to a dielectric radiating element. The dielectric element may include a ground plane connected to a dielectric superstrate. The dielectric superstrate includes multiple dipole layers which include metamaterials and dipoles. The ground plane is configured with a horizontal polarization slot and a plurality of vertical polarization slots. The ground plane is further configured for receiving electrical signals from a power transmission assembly and radiating electromagnetic waves via the polarization slots based upon the received electrical signals. The electromagnetic waves may be transmitted or radiated from the ground plane, may pass through the dielectric superstrate and may then be radiated from the dielectric radiating element. The dielectric radiating element is a dual-polarized radiating element configured with coincident phase centers.

20 Claims, 6 Drawing Sheets

LOW PROFILE DUAL-POLARIZED RADIATING ELEMENT WITH COINCIDENT PHASE CENTERS

FIELD OF THE INVENTION

The present invention relates to the field of advanced sensors and more particularly to a low profile dual-polarized radiating element with coincident phase centers.

BACKGROUND OF THE INVENTION

A number of currently available radiating element systems may not provide a desired level of performance.

Thus, it would be desirable to have a radiating element system which addresses the problem associated with current solutions.

SUMMARY OF THE INVENTION

Accordingly an embodiment of the present invention is directed to a dielectric radiating element, including: a dielectric superstrate, the dielectric superstrate including a plurality of dipole layers, each of the dipole layers including metamaterials and dipoles; and a ground plane, the ground plane being connected to the dielectric superstrate, the ground plane being configured for receiving electrical signals from a power transmission assembly, the ground plane being configured with a horizontal polarization slot and a plurality of vertical polarization slots, the ground plane being further configured for radiating electromagnetic waves via the polarization slots based upon the received electrical signals, the electromagnetic waves being transmitted from the ground plane, through the dielectric superstrate, and being radiated from the dielectric radiating element, wherein the dielectric radiating element is a dual-polarized radiating element configured with coincident phase centers.

A further embodiment of the present invention is directed to a dielectric radiating element system, including: a transmitter, the transmitter being configured for providing electrical signals; a power transmission assembly, the power transmission assembly being connected to the transmitter, the power transmission assembly being configured for receiving the electrical signals from the transmitter; and a dielectric radiating element, the dielectric radiating element being connected to the power transmission assembly, the dielectric radiating element being configured for receiving the electrical signals from the power transmission assembly, the dielectric radiating element including a dielectric superstrate, the dielectric superstrate including a plurality of dipole layers, each of the dipole layers including metamaterials and dipoles, the dielectric radiating element further including a ground plane, the ground plane being connected to the dielectric superstrate, the ground plane being configured for receiving electrical signals from a power transmission assembly, the ground plane being configured with a horizontal polarization slot and a plurality of vertical polarization slots, the ground plane being further configured for radiating electromagnetic waves via the polarization slots based upon the received electrical signals, the electromagnetic waves being transmitted from the ground plane, through the dielectric superstrate, and being radiated from the dielectric radiating element, wherein the dielectric radiating element system is a dual-polarized radiating element system configured with coincident phase centers.

An additional embodiment of the present invention is directed to a radiating element, including: a substrate, the substrate being a generally rectangular-shaped substrate, the substrate including a first generally planar surface and a second generally planar surface, the second generally planar surface being located generally opposite the first generally planar surface, the substrate being configured with a plurality of slots including a first vertical polarization slot, a second vertical polarization slot, and a horizontal polarization slot, the first vertical polarization slot being located generally proximal to a first corner of the substrate, the second vertical polarization slot being located generally proximal to a second corner of the substrate, the second corner being generally opposite the first corner, the horizontal polarization slot being generally centrally located on the substrate and being located between the first vertical polarization slot and the second vertical polarization slot, the radiating element being configured for being connected to a power transmission assembly and a transmitter, the radiating element being further configured for receiving electrical signals from a transmitter via a power transmission assembly and for radiating electromagnetic waves based upon the received electrical signals, wherein the radiating element is a dual-polarized radiating element configured with coincident phase centers.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
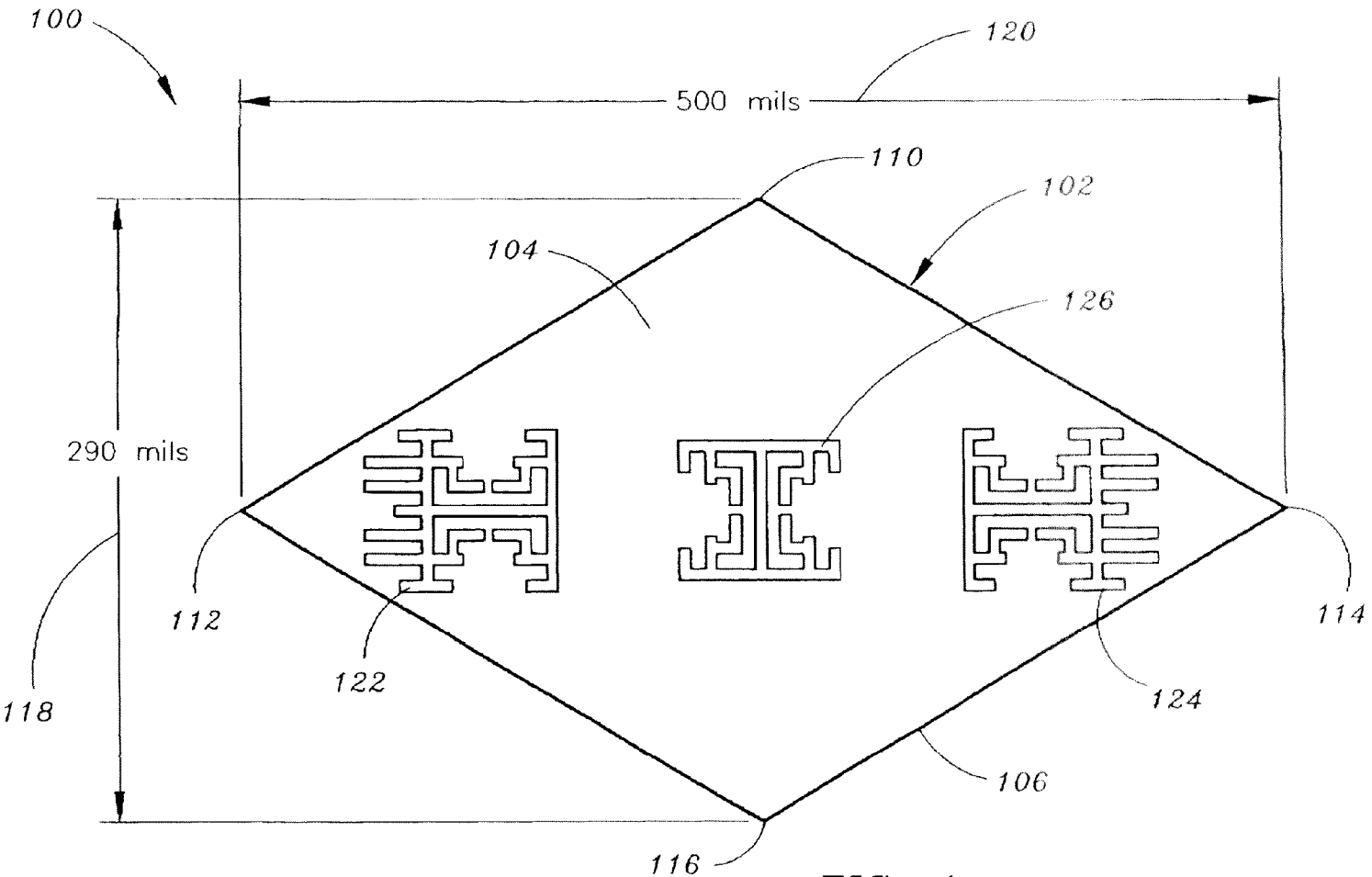
FIG. 1 is an illustration of a radiating element in accordance with an exemplary embodiment of the present invention.

Referring now to FIG. 1, a radiating element (ex.—a ground plane) in accordance with an exemplary embodiment of the present invention is shown. In a current embodiment, the radiating element 100 may be or may include a substrate 102 (ex. —a grid 102). For instance, the grid 102 may be a generally rectangular-shaped or generally square-shaped substrate. In further embodiments, the grid 102 may have a first surface 104 (ex.—a first generally planar surface 104). The grid 102 may further include a second surface 106 (ex.—a second generally planar surface 106).

Figure 2:
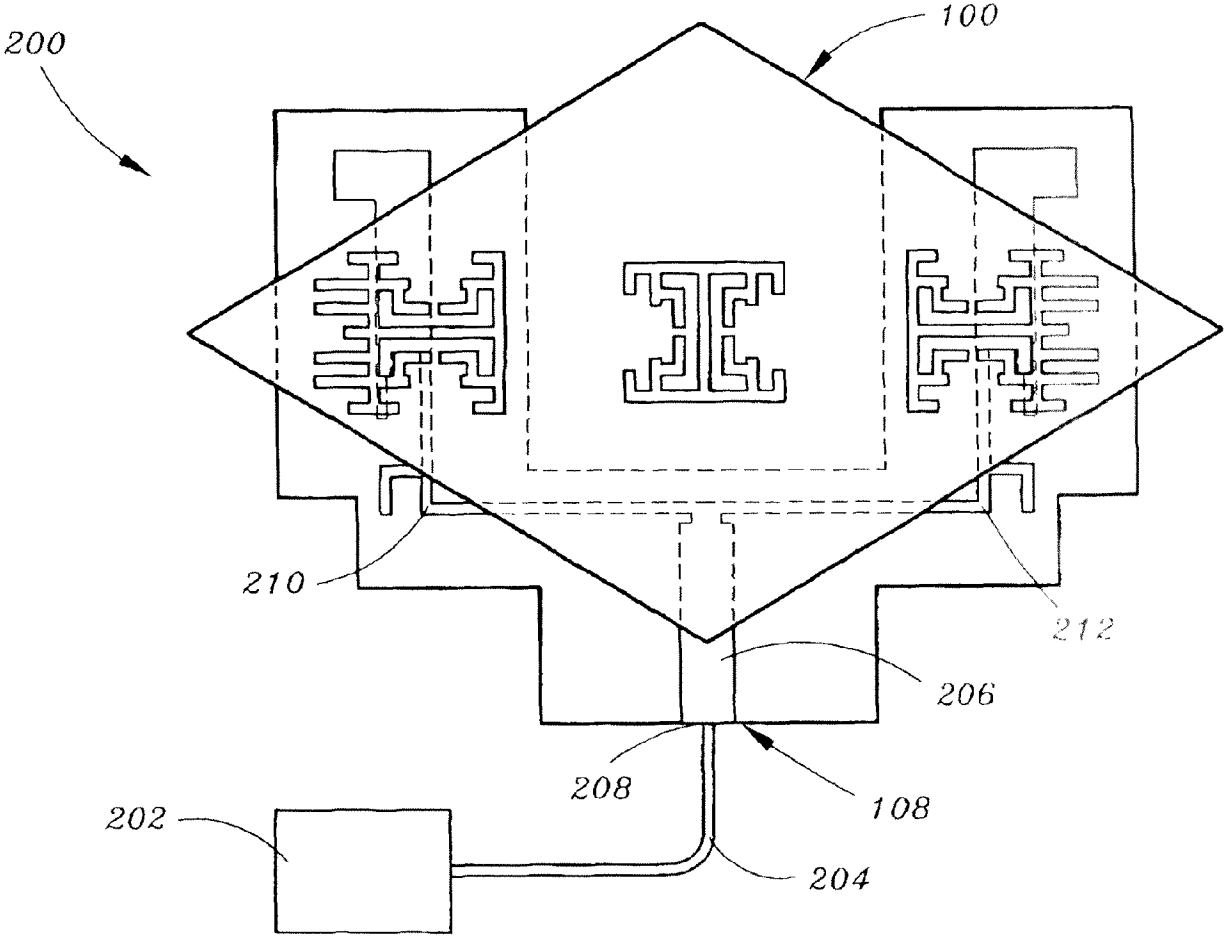
FIG. 2 is a view of a radiating element system, said radiating element system implementing the radiating element of FIG. 1 in accordance with an exemplary embodiment of the present invention.

In current embodiments of the present invention, the first generally planar surface 104 may be located generally opposite the second generally planar surface 106. In exemplary embodiments of the present invention, the first generally planar surface 104 may form a top (ex.—upper) face of the substrate 102 and the second generally planar surface 106 may form a bottom (ex.—lower) face of the substrate 102. For instance, when the substrate 102 is connected to a power transmission assembly 108, as shown in FIG. 2, the bottom face 106 of the radiating element 100 may be oriented towards the power transmission assembly 108, while the upper face 104 may be oriented away from the power transmission assembly 108.

As mentioned above, the substrate 102 may, for example, be generally square-shaped or generally rectangular-shaped. Thus, the substrate 102 may form or may include first, second, third and fourth corners (110, 112, 114, 116). In current embodiments of the present invention, the grid 102 may include a first diameter 118. The first diameter 118 may measure from (ex.—may extend from) the first corner 110 of the substrate 102 to the fourth corner 116 of the substrate 102. In further embodiments of the present invention, the substrate 102 may include a second diameter 120. The second diameter 120 may measure from (ex.—may extend from) the second corner 112 of the substrate 102 to the third corner 114 of the substrate 102. In a current embodiment of the present invention, the first diameter 118 may measure two hundred-ninety mils (290 mils), while the second diameter 120 may measure five hundred mils (500 mils). As used in this application, a mil may be a unit of measure equal to one thousandth of an international inch. Thus, 290 mils may be equal to 0.290 international inches and 500 mils may be equal to 0.500 international inches. One international inch may be equal to 25.4 millimeters.

In exemplary embodiments of the present invention, the substrate 102 may form (ex.—may be configured with) a plurality of apertures (ex.—slots). In a current embodiment of the present invention, the substrate 102 may include one or more vertical polarization slots. For example, the substrate 102 may form (ex.—may be configured with) a first vertical polarization slot 122 and a second vertical polarization slot 124. As shown in the illustrated embodiment, the first vertical polarization slot 122 may be located generally proximal to the second corner 112 of the substrate 102. Further, the second vertical polarization slot 124 may be located generally proximal to the third corner 114 of the substrate 102.

In further embodiments of the present invention, the substrate 102 may also include (ex.—may be configured with) one or more horizontal polarization slots. For instance, the substrate 102 may include (ex.—may form) a horizontal polarization slot 126. As shown in the illustrated embodiment, the horizontal polarization slot 126 may be established such that said horizontal polarization slot 126 is generally centrally located between the first vertical polarization slot 122 and the second vertical polarization slot 124, with said first vertical polarization slot 122, said second vertical polarization slot 124, and said horizontal polarization slot 126 being in a generally linear arrangement (ex.—a generally linear alignment) relative to each other.

Referring now to FIG. 2, a radiating element system in accordance with an exemplary embodiment of the present invention is shown. In current embodiments of the present invention, the radiating element system 200 may include a radiating element 100 as described above. In further embodiments of the present invention, the radiating element 100 may be connected to a transmitter/receiver 202 via a power transmission assembly 108. In current embodiments of the present invention, the power transmission assembly 108 may include a power transmission line 204. The power transmission line 204 may be connected between the transmitter/receiver 202 and the radiating element 100.

In exemplary embodiments of the present invention, the transmitter/receiver 202 may be configured for providing one or more electrical signals to the power transmission line 204. In further embodiments, the power transmission line 204 may be configured for transmitting the one or more electrical signals provided by the transmitter 202 to the radiating element 100. In current embodiments of the present invention, the radiating element 100 may be configured for transmitting (ex.—radiating) one or more electromagnetic waves (ex.—via one or more of the polarization slots (122, 124, 126) of the radiating element 100) based upon the one or more electrical signals.

In additional embodiments of the present invention, the power transmission assembly 108 may further include a reactive power divider 206. In exemplary embodiments of the present invention, the reactive power divider 206 may be a passive device (ex.—a device which consumes but does not produce energy, and/or a device which is incapable of power gain). In further embodiments, the reactive power divider 206 may be connected to the power transmission line 204. In exemplary embodiments of the present invention, the reactive power divider 206 may include an input port 208 and a plurality of output ports (ex.—output arms). For instance, the reactive power divider 206 may include a first output port 210 and a second output port 212.

In current embodiments of the present invention, the reactive power divider 206 may be configured for receiving the one or more electrical signals (ex.—the input power) at the input port 208, said one or more electrical signals being provided via the power transmission line 204. In further embodiments of the present invention, the reactive power divider 206 may be configured for dividing the received electrical signal(s) (ex.—the received input power). In additional embodiments, the reactive power divider 206 may be configured for providing the divided signals (ex.—the divided input power) via the output ports (210, 212) of the reactive power divider 206 to the radiating element 100.

In exemplary embodiments of the present invention, the output arms (210, 212) may be electrically connected to the radiating element 100. In further embodiments of the present invention, the reactive power divider 206 may be configured for dividing the input power evenly between the output arms (210, 212). For instance, generally equal (ex.—equal) portions of the divided input power may be provided to the first output arm 210 and the second output arm 212. Further, the divided input power may be provided as a divider output via the output arms (210, 212) to the radiating element 100. In current embodiments of the present invention, the reactive power divider 206 may be a Wilkinson power divider. The Wilkinson power divider 206 may be configured for achieving isolation between its output arms (210, 212), while maintaining a matched condition on all ports of the Wilkinson power divider 206.

As mentioned above, the radiating element 100 and the radiating element system 200 may be configured for transmitting (ex.—providing, radiating, etc.) one or more electromagnetic waves (ex.—via one or more of the polarization slots (122, 124, 126) of the radiating element 100) based upon the one or more electrical signals. In an exemplary embodiment of the present invention, the radiating element 100 of the radiating element system 200 may be a dual-polarized (ex.—dual pole) radiating element 100. For instance, the radiating element 100 may be configured for providing (ex.—acting as) a vertically-polarized antenna and/or a vertically-polarized antenna array (ex.—by radiating electromagnetic waves, vertically-polarized waves, and/or electromagnetic waves having a vertically-polarized radiation pattern via the vertical polarization slots 122, 124). The radiating element 100 may be further configured for acting as a horizontally-polarized antenna and/or as a horizontally-polarized antenna array (ex.—by radiating electromagnetic waves, horizontally-polarized waves, and/or electromagnetic waves having a horizontally-polarized radiation pattern via the horizontal polarization slot 126).

In current embodiments of the present invention, the radiating element 100 and/or radiating element system 200 may be configured such that the radiating element 100 has coincident phase centers. By having coincident phase centers, the radiating element 100 and/or radiating element system 200 of the present invention may allow for the radiating element/antenna/antenna module 100 to appear as a point source of radiation (ex.—Radio Frequency (RF) energy) from far field.

In exemplary embodiments of the present invention, the radiating element 100 and/or radiating element system 200 may be configured for use with (ex.—on-board) Unmanned Aerial Vehicles (UAVs). In further embodiments of the present invention, the radiating element 100 and/or radiating element system 200 may be configured as a wide band radiating element and/or a wide band radiating element system. For instance, the radiating element 100 and/or radiating element system 200 may provide approximately or exactly the same operating characteristics over a very wide passband. In additional embodiments of the present invention, the radiating element 100 and/or radiating element system 200 may be a configured as a wide scan radiating element and/or a wide scan radiating element system. For example, the radiating element 100 and/or radiating element system 200 may be configured for performing scans over a scan angle of at least seventy (70) degrees. In still further embodiments, the radiating element 100 may be configured with a suitable thickness for providing a very low profile radiating element 100.

In current embodiments of the present invention, the radiating element 100 and/or radiating element system 200 may be configured for performing a variety of scans, such as array normal scans, vertical scans, horizontal scans and inter-cardinal scans. In further embodiments of the present invention, array normal scans and vertical scans may not require a Wilkinson power divider 206 for vertical scan. In additional embodiments, horizontal and inter-cardinal scans may require a Wilkinson power divider/Wilkinson feed 206 for the vertical polarization slots. In still further embodiments, the radiating element system 200 may also (or alternatively) be configured for receiving electromagnetic waves and converting said electromagnetic waves into electrical current.

Figure 3:
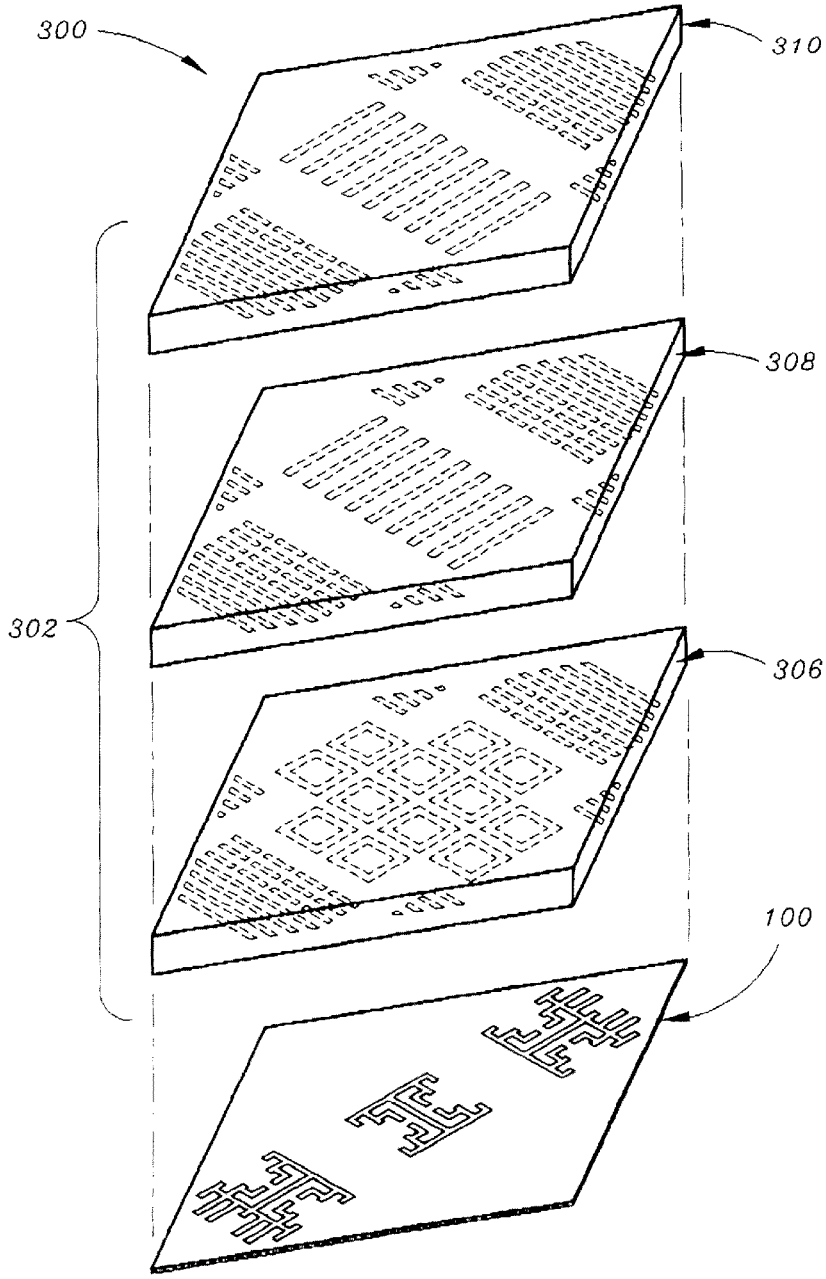
FIG. 3 is an exploded view showing the radiating element of FIG. 1 being implemented with a dielectric superstrate to form a dielectric radiating element in accordance with a further exemplary embodiment of the present invention.

In further embodiments of the present invention, as shown in FIG. 3, the radiating element 100 (ex.—ground plane 100) may be connected to (ex.—may be in physical and electrical contact with) a dielectric superstrate 302 (ex.—a radiating element superstrate 302) to form a dielectric radiating element 300. For example, when connected, the upper face 104 of the ground plane 100 may be oriented toward the dielectric superstrate 302. The slots (122, 124, 126) of the ground plane 100 may be configured for feeding the dielectric superstrate 302. Electromagnetic energy may radiate from the radiating element 100 (ex.—via the polarization slots 122, 124, 126), through the dielectric superstrate 302 (ex.—upward through the dielectric superstrate 302), and into free space. This configuration essentially allows the superstrate 302 to couple the electromagnetic energy from the slots (122, 124, 126) to free space.

Figure 4:
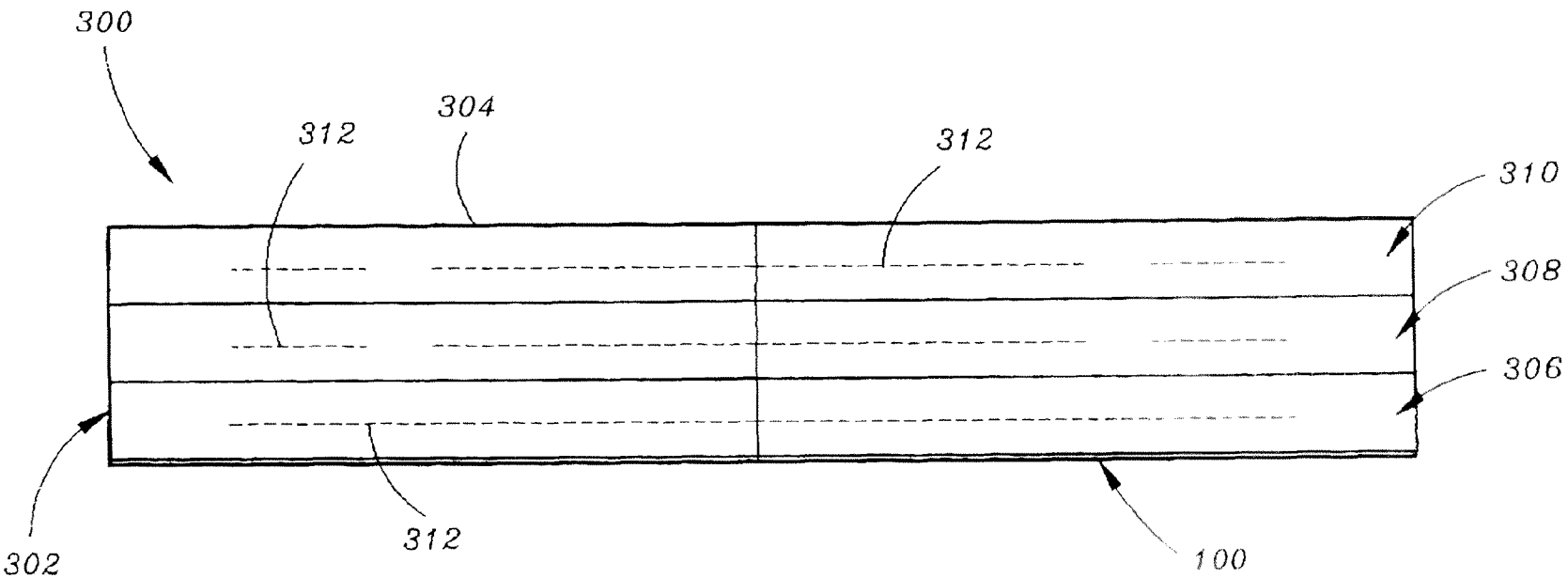
FIG. 4 is a cross-sectional view of the dielectric radiating element shown in FIG. 3, in accordance with a further exemplary embodiment of the present invention.
Figure 5A:
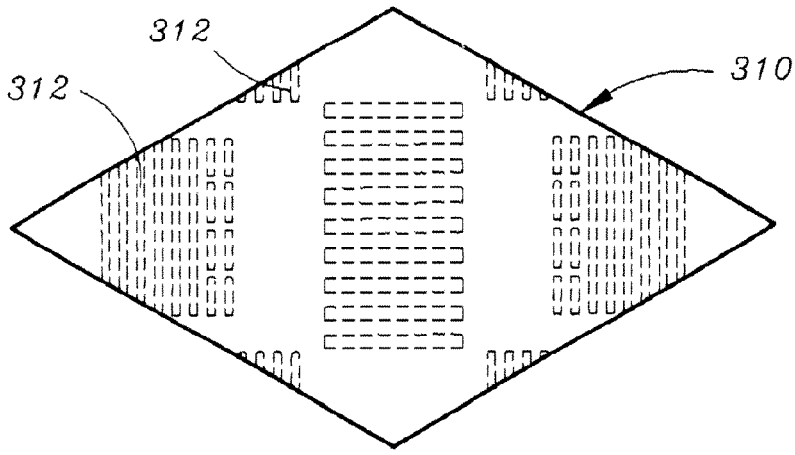
FIGS. 5A, 5B and 5C show views of a top dipole layer, a middle dipole layer, and a bottom dipole layer of the dielectric superstrate of the dielectric radiating element shown in FIG. 4 in accordance with further exemplary embodiments of the present invention.
Figure 5B:
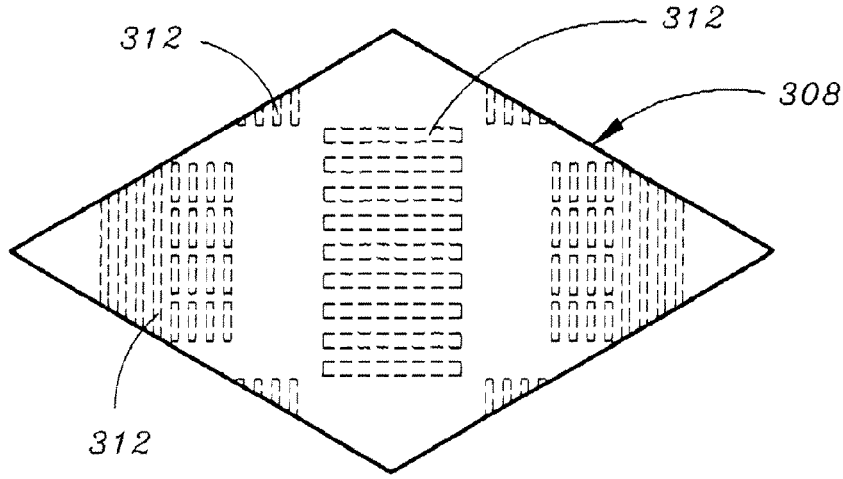
Figure 5C:
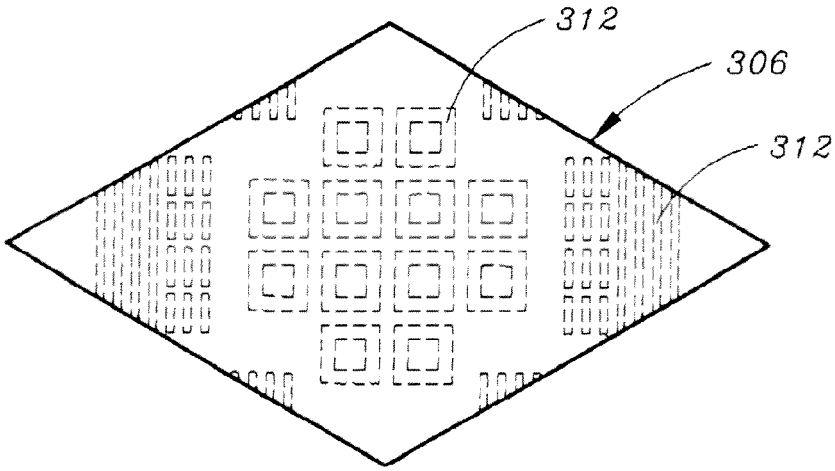

Referring to FIG. 4, a cross-sectional view of the dielectric radiating element 300 is shown in accordance with an exemplary embodiment of the present invention. In the illustrated embodiment, the dielectric superstrate 302 of the dielectric radiating element 300 may include (ex.—may be at least partially formed of) a layer of dielectric material 304. For instance, the layer of dielectric material 304 may be Rogers 6002 or the like. In further embodiments, the dielectric superstrate 302 may further include a plurality of dipole layers. For example, the plurality of dipole layers may be at least substantially formed within the dielectric superstrate 302. In the illustrated embodiment, three dipole layers (306, 308, 310), each including metamaterial and dipoles 312, are included within the dielectric superstrate 302. Further, the dielectric superstrate 302 may be correspondingly-shaped and sized with the ground plane 100. For instance, if the ground plane is rectangularly-shaped, the dielectric superstrate 302 may also be rectangularly-shaped and may have similar diameter dimensions to the ground plane, thereby providing a rectangularly-shaped dielectric radiating element. The first dipole layer 306, second dipole layer 308 and third dipole layer 310 are shown in FIGS. 5A, 5B and 5C. In exemplary embodiments, the first dipole layer 306 (shown in FIG. 5C) may be the lowest or bottom dipole layer 306, such that when the radiating element 100 is connected to the dielectric superstrate 302, the first dipole layer 306 may be in direct physical contact with the radiating element. In further embodiments, the second dipole layer 308 (shown in FIG. 5B) may be the middle dipole layer 308, such that said second dipole layer 308 may be stacked upon the first dipole layer 306. In still further embodiments, the third dipole layer 310 (shown in FIG. 5A) may be the top dipole layer 310, such that said third dipole layer 310 may be stacked upon the second dipole layer 308, thereby sandwiching the second dipole layer 308 between the third dipole layer 310 and the first dipole layer 306.

Figure 6:
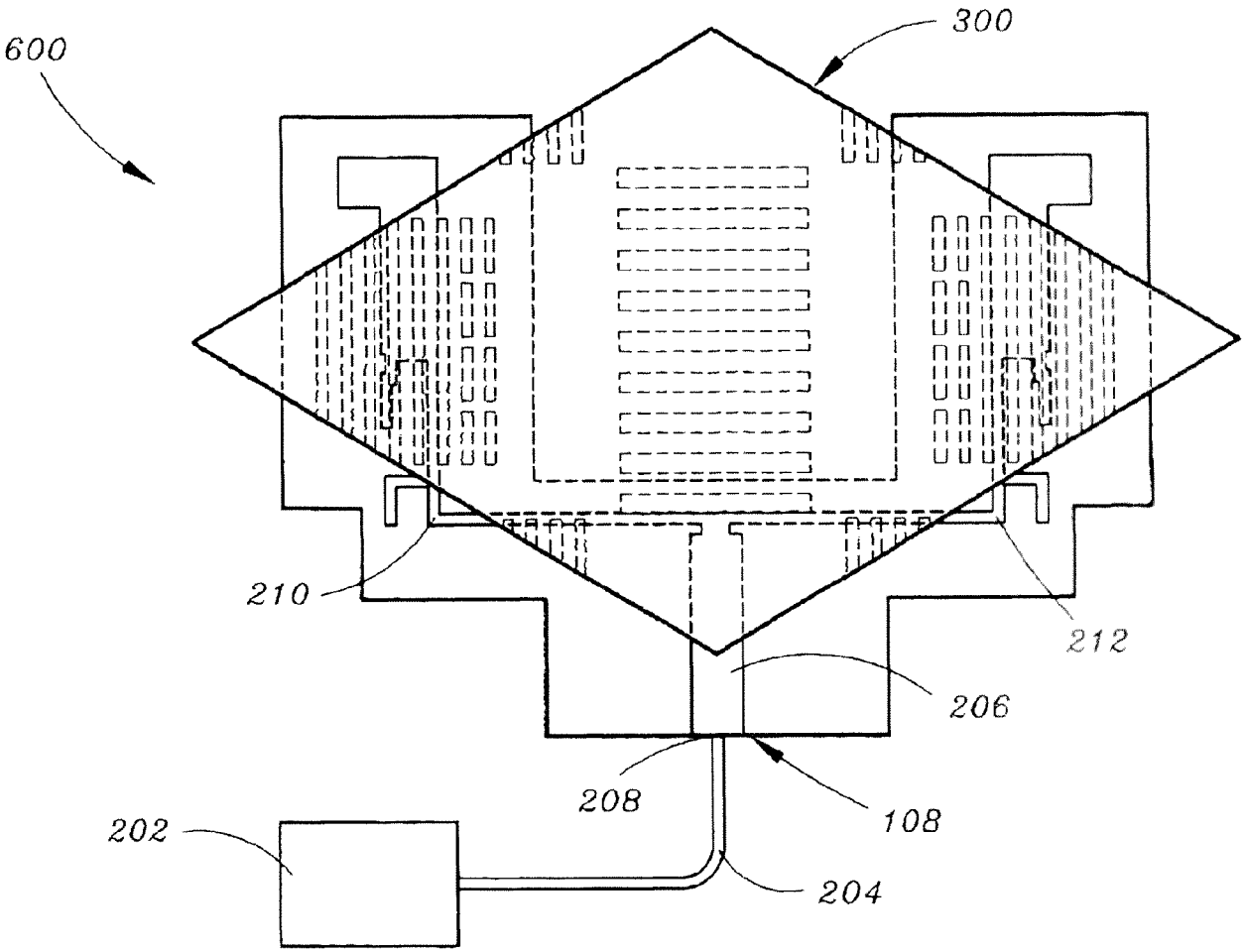
FIG. 6 is a view of a dielectric radiating element system, said dielectric radiating element system implementing the dielectric radiating element of FIG. 4 in accordance with an exemplary embodiment of the present invention.

In exemplary embodiments of the present invention, the dielectric radiating element 300 may be connected to a transmitter/receiver 202 via a power transmission assembly 108, thereby providing a dielectric radiating element system 600, as shown in FIG. 6. The dielectric radiating element 300 may receive electrical signal(s) from transmitter 202 via the transmission line 204 of the power transmission assembly 108, and the ground plane 100 of the dielectric radiating element 300 may be configured for transmitting electromagnetic waves via its polarization slots (122, 124, 126) based upon the electrical signal(s). In further embodiments, the electrical signals received by the dielectric radiating element 300 may be power divided signals provided via a reactive power divider 206 of the power transmission assembly 108. In further embodiments, the dielectric radiating element 300 may be a dual-polarized radiating element 300 configured for radiating vertically-polarized radiation patterns and horizontally-polarized radiation patterns. Further, the dielectric radiating element 300 may have coincident phase centers.

In further embodiments, the dielectric radiating element 300 and/or dielectric radiating element system 600 may be configured for use with UAVs. Further, the dielectric radiating element 300 and/or dielectric radiating element system 600 may be configured as wide band and/or wide scan.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A dielectric radiating element, comprising:

a dielectric superstrate, the dielectric superstrate including a plurality of dipole layers, each of the dipole layers including metamaterials and dipoles; and a ground plane, the ground plane being connected to the dielectric superstrate, the ground plane being configured for receiving electrical signals from a power transmission assembly, the ground plane being configured with a horizontal polarization slot and a plurality of vertical polarization slots, the ground plane being further configured for radiating electromagnetic waves via the polarization slots based upon the received electrical signals, the electromagnetic waves being transmitted from the ground plane, through the dielectric superstrate, and being radiated from the dielectric radiating element, wherein the dielectric radiating element is a dual-polarized radiating element configured with coincident phase centers.

2. A dielectric radiating element as claimed in claim 1, wherein the ground plane is a rectangular-shaped substrate, the substrate including a first planar surface and a second planar surface, the second planar surface being configured generally opposite the first planar surface, the second planar surface being connected to the power transmission assembly.

3. A dielectric radiating element as claimed in claim 2, wherein a first vertical polarization slot included in the plurality of vertical polarization slots is located proximal to a first corner of the substrate, and a second vertical polarization slot included in the plurality of vertical polarization slots is located proximal to a second corner of the substrate, the second corner being generally opposite the first corner.

4. A dielectric radiating element as claimed in claim 3, wherein the horizontal polarization slot is generally centrally located on the substrate, the horizontal polarization slot being located between the first vertical polarization slot and the second vertical polarization slot, said horizontal polarization slot, said first vertical polarization slot, and said second vertical polarization slot being in a generally linear alignment.

5. A dielectric radiating element as claimed in claim 1, wherein the radiating element is configured for radiating vertically-polarized radiation patterns and horizontally-polarized radiation patterns.

6. A dielectric radiating element system, comprising:

a transmitter, the transmitter being configured for providing electrical signals;

a power transmission assembly, the power transmission assembly being connected to the transmitter, the power transmission assembly being configured for receiving the electrical signals from the transmitter; and a dielectric radiating element, the dielectric radiating element being connected to the power transmission assembly, the dielectric radiating element being configured for receiving the electrical signals from the power transmission assembly, the dielectric radiating element including a dielectric superstrate, the dielectric superstrate including a plurality of dipole layers, each of the dipole layers including metamaterials and dipoles, the dielectric radiating element further including a ground plane, the ground plane being connected to the dielectric superstrate, the ground plane being configured for receiving electrical signals from a power transmission assembly, the ground plane being configured with a horizontal polarization slot and a plurality of vertical polarization slots, the ground plane being further configured for radiating electromagnetic waves via the polarization slots based upon the received electrical signals, the electromagnetic waves being transmitted from the ground plane, through the dielectric superstrate, and being radiated from the dielectric radiating element, wherein the dielectric radiating element system is a dual-polarized radiating element system configured with coincident phase centers.

7. A dielectric radiating element system as claimed in claim 6, wherein the power transmission assembly includes a power transmission line.

8. A dielectric radiating element system as claimed in claim 7, wherein the power transmission assembly includes a reactive power divider, the reactive power divider being connected to the power transmission line.

9. A dielectric radiating element system as claimed in claim 8, wherein the reactive power divider includes an input port and a plurality of output ports, the input port being connected to the power transmission line, the output ports being connected to the radiating element.

10. A dielectric radiating element system as claimed in claim 9, wherein the reactive power divider is configured for: receiving the electrical signals from the power transmission line via the input port; dividing the electrical signals; and providing the divided electrical signals to the dielectric radiating element via the output ports of the reactive power divider.

11. A dielectric radiating element system as claimed in claim 10, wherein the reactive power divider is a Wilkinson power divider.

12. A dielectric radiating element system as claimed in claim 6, wherein the dielectric radiating element is a rectangular-shaped substrate, the ground plane of the dielectric radiating element including a first planar surface and a second planar surface, the second planar surface being configured generally opposite the first planar surface, the second planar surface being connected to the power transmission assembly.

13. A dielectric radiating element system as claimed in claim 12, wherein the first vertical polarization slot is located proximal to a first corner of the substrate, the second polarization slot being located proximal to a second corner of the substrate, the second corner being generally opposite the first corner.

14. A dielectric radiating element system as claimed in claim 13, wherein the horizontal polarization slot is generally centrally located on the substrate, the horizontal polarization slot being located between the first vertical polarization slot and the second vertical polarization slot, said horizontal polarization slot, said first vertical polarization slot, and said second vertical polarization slot being in a generally linear alignment.

15. A dielectric radiating element system as claimed in claim 6, wherein the dielectric radiating element system is configured for implementation on-board an Unmanned Aerial Vehicle.

16. A radiating element, comprising:

a substrate, the substrate being a generally rectangular-shaped substrate, the substrate including a first generally planar surface and a second generally planar surface, the second generally planar surface being located generally opposite the first generally planar surface, the substrate being configured with a plurality of slots including a first vertical polarization slot, a second vertical polarization slot, and a horizontal polarization slot, the first vertical polarization slot being located generally proximal to a first corner of the substrate, the second vertical polarization slot being located generally proximal to a second corner of the substrate, the second corner being generally opposite the first corner, the horizontal polarization slot being generally centrally located on the substrate and being located between the first vertical polarization slot and the second vertical polarization slot, the radiating element being configured for being connected to a power transmission assembly and a transmitter, the radiating element being further configured for receiving electrical signals from the transmitter via the power transmission assembly and for radiating electromagnetic waves based upon the received electrical signals, wherein the radiating element is a dual-polarized radiating element configured with coincident phase centers.

17. A radiating element as claimed in claim 16, wherein the radiating element is configured for radiating a vertically-polarized radiation pattern and a horizontally-polarized radiation pattern.

18. A radiating element as claimed in claim 17, wherein the radiating element is configured for being connected to a reactive power divider.

19. A radiating element as claimed in claim 16, wherein the radiating element has a first diameter of 500 mils, the first diameter measuring from the first corner of the substrate to the second corner of the substrate.

20. A radiating element as claimed in claim 19, wherein the radiating element has a second diameter of 290 mils, the second diameter measuring from a third corner of the substrate to a fourth corner of the substrate.

* * * * *